US007855642B2

(12) United States Patent
Veiga, III

(10) Patent No.: US 7,855,642 B2
(45) Date of Patent: Dec. 21, 2010

(54) PORTABLE MOTION-DETECTING ALARM WITH REMOTE NOTIFICATION

(76) Inventor: William Veiga, III, 4246 E. Dublin St., Gilbert, AZ (US) 85295

( * ) Notice: Subject to any disclaimer, the term of this patent is extended or adjusted under 35 U.S.C. 154(b) by 274 days.

(21) Appl. No.: 12/145,492

(22) Filed: Jun. 24, 2008

(65) Prior Publication Data

US 2009/0009326 A1 Jan. 8, 2009

Related U.S. Application Data

(60) Provisional application No. 60/948,442, filed on Jul. 7, 2007.

(51) Int. Cl.
*G08B 13/14* (2006.01)

(52) U.S. Cl. ..... 340/571; 340/539.1; 340/539.11; 340/539.23; 340/541; 340/573.1

(58) Field of Classification Search ..... 340/539.11, 340/539.1, 539.23, 541, 571, 573.1
See application file for complete search history.

(56) References Cited

U.S. PATENT DOCUMENTS

| | | | | |
|---|---|---|---|---|
| 4,947,151 | A | 8/1990 | Rosenberger | |
| 5,081,667 | A | 1/1992 | Drori et al. | |
| 5,408,212 | A * | 4/1995 | Meyers et al. | 340/427 |
| 5,432,495 | A | 7/1995 | Tompkins | |
| 5,739,748 | A | 4/1998 | Flick | |
| 5,793,284 | A | 8/1998 | Teague | |
| 5,870,020 | A | 2/1999 | Harrison, Jr. | |
| 5,990,785 | A | 11/1999 | Suda | |
| 6,028,506 | A | 2/2000 | Xiao | |
| 6,335,679 | B1 | 1/2002 | Thomas et al. | |
| 6,563,421 | B1 | 5/2003 | Wheeler | |
| 6,693,563 | B2 | 2/2004 | Flick | |
| 6,734,790 | B1 | 5/2004 | Hodger | |
| 6,741,187 | B2 | 5/2004 | Flick | |
| 6,828,909 | B2 * | 12/2004 | Script et al. | 340/545.1 |
| 6,927,675 | B2 | 8/2005 | Losee | |
| 6,956,467 | B1 | 10/2005 | Mercado et al. | |
| 7,019,640 | B2 * | 3/2006 | Canich et al. | 340/531 |
| 7,062,281 | B2 | 6/2006 | Blink et al. | |
| 7,064,657 | B2 * | 6/2006 | Becker et al. | 340/426.1 |
| 7,138,904 | B1 | 11/2006 | Dutu | |
| 7,149,623 | B2 | 12/2006 | Flick | |
| 7,164,921 | B2 | 1/2007 | Owens et al. | |
| 7,468,667 | B2 * | 12/2008 | Moffett | 340/571 |
| 7,646,973 | B2 * | 1/2010 | Howard et al. | 396/155 |
| 7,701,339 | B2 * | 4/2010 | Irmscher et al. | 340/568.1 |
| 2002/0113704 | A1 * | 8/2002 | Hess | 340/568.2 |

(Continued)

*Primary Examiner*—Hung T. Nguyen
(74) *Attorney, Agent, or Firm*—Gerald E Linden; Dwight A Stauffer

(57) ABSTRACT

A Disturbance-Sensing System comprises a fixed unit comprising a small and self-powered unit for associating with an object being protected, and for sensing an alarm event such as movement of the object being protected, and for remotely notifying the an owner or person responsible for the object being protected that the alarm event is occurring; and a mobile unit which may be carried by an owner of or person responsible for the object being protected, for receiving the notification of the alarm event. The fixed unit may be attached to or otherwise disposed in, on or in proximity to the object being protected. The mobile unit may comprise a user's cell phone. Various means for attaching the fixed unit to an object being protected are disclosed.

18 Claims, 1 Drawing Sheet

U.S. PATENT DOCUMENTS

2005/0012591 A1 1/2005 Tomljenovic et al.
2005/0179548 A1* 8/2005 Kittel et al. ..... 340/568.2
2005/0258945 A1 11/2005 Chen et al.
2007/0030129 A1 2/2007 O'Neill
2008/0073431 A1* 3/2008 Davis ..... 235/383
2008/0297346 A1* 12/2008 Brackmann et al. ..... 340/572.1

* cited by examiner

PORTABLE MOTION-DETECTING ALARM WITH REMOTE NOTIFICATION

CROSS-REFERENCE TO RELATED APPLICATIONS

The present invention claims priority from Provisional Application 60/948,442 filed Jul. 7, 2007 by Veiga.

FIELD OF THE INVENTION

The invention relates to alarm devices (disturbance-sensing systems) and, more particularly, to motion-detecting alarm devices which are portable and which can be associated with various protected items, such as a hotel room door.

BACKGROUND OF THE INVENTION

Motion-detecting alarm devices are known, and can be used with nearly any object ("protected item") that may be moved against an owner's wishes. Such devices are generally portable (i.e., small, such as the size of a coffee cup) and battery-operated. Such devices typically comprise a motion-detecting sensor (such as a mercury switch), and an audible alarm, and can be associated with (such as temporarily attached to or suspended from) a protected item such as a hotel room door. For example, when the protected item is disturbed, the alarm sounds and alerts the owner to an intrusion. A time delay (such as 5-10 seconds) may be incorporated into the alarm device.

RELATED PATENTS AND PUBLICATIONS

The following US patents (USP) and Published Applications (US) are incorporated by reference herein:

US 2005/0012591 discloses a system and apparatus for detecting unauthorized movement of a moveable object where the system includes a GPS receiver, cellular modulator, processor, pager modem, sensor and two-way pager. When the system is coupled to a moveable object and is armed via the pager, the sensor is monitored by the processor to determine when a possible theft of the moveable object may be occurring. In an embodiment, the sensor is a multiple axis accelerometer. In one embodiment the accelerometer is a two axes accelerometer where the sensor detects small movements of the object is two axes. When the sensor is triggered, the processor pages the two-way pager. The processor also determines the system's location via the GPS receiver. The processor generates a message including the system's location and unique system identifier. The processor transmits the message to a monitoring center via a cellular network (and the cellular modulator). In one embodiment, the message is a text message and transmitted using a GSM, GPRS, or Short Messaging Service cellular based network.

U.S. Pat. No. 5,739,748 discloses a method of using a common carrier paging receiver carried by a vehicle user to alert the user of a vehicle security breach includes the steps of: providing a vehicle alarm transmitter at the vehicle for transmitting a vehicle security alarm signal compatible with common carrier paging signals; sensing for a breach of vehicle security using at least one vehicle security sensor; and transmitting the vehicle security alarm signal from the vehicle alarm transmitter responsive to a sensed breach of vehicle security. The method preferably further comprises the steps of: directly receiving the vehicle security alarm signal at the common carrier paging receiver from the vehicle alarm transmitter without using other portions of the common carrier paging network; and indicating a vehicle security breach to the vehicle user via the common carrier paging receiver responsive to receipt of the vehicle security alarm signal. Accordingly, the vehicle user can receive both common carrier paging signals and the vehicle security alarm signal using the common carrier paging receiver. In addition, the vehicle alarm security signal is transmitted and received without using any portion of the common carrier network, so that no common carrier resources are used or charges incurred. Apparatus aspects of the invention are also disclosed U.S. Pat. No. 6,563,421 discloses a security system (10) for providing a remote indication of a breach in security including an electronic device with an electronic device body (12) and a disabling member (14) couplable thereto. The electronic device is disabled by removing the disabling member. A security breach causes an alarm signal to be sent to the disabling member (14), which announces the receipt of an alarm signal. The electronic device can be a vehicle sound-reproduction device, and the disabling member (14) can be all or a portion of a face thereof. The alarm signal can be sent first by radio transmission that, if necessary, can be supplemented by a mobile communications transmission. The disabling member (14) could further act as a mobile communications pager and as a mobile telephone. The disabling member (14) could operate to affect operation of a vehicle in which the security system (10) is employed.

U.S. Pat. No. 6,927,675 discloses a portable alarm system including a cigarette lighter socket mount which is useful to deploy a flexible beam structure in cantilever. An electrical board mounted eccentrically from the other end of the beam structure then provides the torsional and bending motions that are inducted in the course of illegal entry, these motions then being sensed by tank circuits connected to corresponding comparators. The output of each comparator is then combined in a logical AND and OR combination that is manually selected by a switch to turn on a sending unit that then communicates with a remote device like a pager.

U.S. Pat. No. 5,870,020 discloses a vehicle alarm for providing remote indication of infiltration. A vehicle alarm is provided including a vehicle unit situated within a vehicle. The vehicle unit includes a transmitter for transmitting an activation signal via free space upon the receipt of an alarm signal. An intrusion detection mechanism is adapted to generate an intrusion signal upon the unauthorized infiltration of the vehicle. Another component of the vehicle unit, control means, is adapted to transmit the alarm signal to the transmitter means upon the receipt of the intrusion signal. Next provided is a home unit situated within a house with a dialer for contacting an emergency entity upon the actuation thereof. The home unit further includes a receiver for effecting the actuation of the dialer upon the receipt of the activation signal via free space.

US Patent Publication 2005/0258945 discloses a wireless vehicle burglar-alarm system formed of an on-board main unit and a wireless communication is disclosed. The on-board main unit obtains the CGI (Cell Global Identity) of a wireless communication base station from its broadcast and stores the CGI in a memory, and sends a re-location signal to the on-board main unit when the storage CGI is changed during an alert mode of the on-board main unit, causing the on-board main unit to start the at least one alarm. The on-board main unit sends an alarm signal to an alarm and drives the wireless communication apparatus to send an alarm message to the car owner wirelessly upon detection of an abnormal condition of the car through a sensor.

U.S. Pat. No. 5,432,495 discloses a beeper controlled auto security system in which a vehicle disabling device such as an ignition kill switch is selectively activated either by a hand held RF transmitter unit or a beeper paging system satellite transmission initiated by a telephone call which may be at a very remote location from the vehicle. A vehicle motion detector is also activated which turns on a monitor transmitter if the vehicle is thereafter moved, enabling detection by a portable monitor receiver carried by the vehicle owner or police vehicles.

U.S. Pat. No. 6,335,679 discloses a vehicle alarm system (20) includes an alert transmitter (32), alert receiver (44), alert device (46), arming unit (42), alarm unit (28), and alarm device (30). The alert transmitter (32), alert receiver (44), and alert device (46) are added to the arming unit (42), alarm unit (28), and alarm device (30) of an existing vehicle alarm system to notify a vehicle owner that an alarm condition has occurred when the vehicle owner is beyond audible range of the alarm device (30). An arming unit power source (52) and arming unit controls (54,56) are used to power and control the alert receiver (44) and alert device (46), and the arming unit (42) is coupled with an alert housing (50) to provide a unitary remote assembly (24. A pager unit (72) is provided in the vehicle passenger compartment and transmits a pager signal to the alarm unit (28B). When used with the pager unit (72), the alert receiver (44) is replaced with a transceiver (74) which operates to send an acknowledgment signal (80) back to the pager unit (72) to deactivate a pager indicator light (76). The alert transmitter (32B) is operable to send an encoded wireless signal (40B) to the alert transceiver (74) to inform the vehicle owner of the nature of the alarm condition that has occurred.

The following U.S. patents and publications are also referenced: U.S. Pat. Nos. 4,947,151; 5,018,667; 5,793,284; 5,990,785; 6,028,506; 6,693,563; 6,734,790; 6,741,187; 6,956,467; 7,062,281; 7,138,904; 7,149,623; 7,164,921; and US Patent Publication 2007/0030129.

SUMMARY OF THE INVENTION

A need exists, for example, for an effective, affordable and portable device that may be a deterrent to theft and may notify an owner if a protected item or space is disturbed when a motion alarm is activated.

According to the invention, generally, a disturbance-sensing system is self-contained and portable, and can be associated with various objects to be protected. When a disturbance occurs, such as movement of the protected object, the owner (or custodian) of the object may be remotely notified of the disturbance, such as by cell phone According to an embodiment of the invention, a disturbance-sensing system comprises: a fixed unit comprising a small and self-powered unit for associating with an object being protected, and for sensing an alarm event such as movement of the object being protected, and for remotely notifying the an owner or person responsible for the object being protected that the alarm event is occurring; and a mobile unit which may be carried by an owner of or person responsible for the object being protected, for receiving the notification of the alarm event. The fixed unit may comprise means for attaching the fixed unit to or otherwise disposing the fixed unit in, on or in proximity to the object being protected. The mobile unit may comprise a cell phone. A communication link may be established between the fixed unit and the mobile unit; wherein the communication link comprises a direct link or an indirect link; and wherein the communication link comprises a cellular network, a paging network, or the Internet.

The fixed unit may comprise an elongate, hollow housing, generally in the form of a flashlight. The fixed unit may comprise one or more output devices for indicating operating conditions of the fixed unit. The fixed unit may comprise a receiver for receiving a signal from the mobile unit to remotely select a mode of operation for the fixed unit. The fixed unit may comprise one or more data ports so that the fixed unit may be connected with a computer.

The fixed unit may comprise one or more disturbance-sensors for sensing an alarm event, at least one of which is a motion-detector; a control unit receiving signals from the disturbance sensors, and managing overall operation of the fixed unit; one or more power sources for operating the fixed unit; one or more input devices for controlling operating states of the fixed unit; and one or more transceivers or modems for establishing a communication link between the fixed unit and the mobile unit, selected from the group consisting of: a direct RF connection between the fixed unit and the mobile unit; an indirect connection via the cellular phone network; an indirect connection via a pager network; and an indirect connection via a wireless computer network The system may be used to alert, and help protect from unauthorized entry, such as unauthorized entry into a home, office, storage space, locker, garage, shed, or other space which may be secured; and the object bring protected may be selected from the group consisting of: a car, a bicycle, a motorcycle, a truck, a jet ski, a boat, a shipment of valuable goods, valuable moveable property, a door, a window, a briefcase, a computer case, a musical instrument, a gym locker, or gym bag, a fence gate, a hotel room door, a swimming pool float alarm, a baby's crib, and generally, any item that is susceptible to tampering or theft.

According to an embodiment of the invention, a fixed unit for a disturbance-sensing system comprises: a small, self-powered unit for associating with an object being protected, and for sensing an alarm event such as movement of the object being protected, and for remotely notifying the an owner or person responsible for the object being protected that the alarm event is occurring; the fixed unit may be in the general form of an elongate, generally cylindrical, hollow housing, such as generally in the form of a common household flashlight, and batteries disposed in the housing. First one or more of the batteries may be rechargeable batteries, and second one or more batteries may be backup batteries. A flip out plug may be provided on an external surface of the housing for plugging the unit into household current for the purpose of recharging the batteries.

A non-locking strap may be provided and a slotted bracket disposed on an external surface of the housing for use with the strap.

A locking strap may be provided for securing the fixed unit to the object being protected; and requiring a key for removing the fixed unit from the object being protected. The locking strap may comprise a flexible cable that is made of wound steel, plastic, or other durable material that is resistant to cutting. The locking strap may be positioned at an end of the housing, having a first end which is secured to the housing and a second, free end which may be inserted from external the housing through an opening in the housing and exit a side surface of the housing. Means may be provided for retaining the free end of the locking strap in place, and for releasing the locking strap when a key is inserted.

A hook may be provided, extending from an end of the housing, so that the so that the fixed unit can be hung from the object being protected.

A magnetic strip may be provided along a side of the housing so that the fixed unit can be magnetically attached to the object being protected.

Other objects, features and advantages of the invention may become apparent in light of the following description thereof.

BRIEF DESCRIPTION OF THE DRAWINGS

The structure, operation, and advantages of the present invention will become further apparent upon consideration of the following description taken in conjunction with the accompanying figures (FIGS.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In some of the figures, some elements may be drawn with very straight edges intersecting with other edges at precise (such as 90-degree) angles, for illustrative clarity. One of ordinary skill in the art will appreciate that the edges may not be so straight, and the intersections may be rounded. The drawings included herewith are intended to be instructional, and are not intended to be (nor are they required to be) detailed "manufacturing drawings".

DETAILED DESCRIPTION OF THE INVENTION

In the description that follows, numerous details are set forth in order to provide a thorough understanding of the present invention. It will be appreciated by those skilled in the art that variations of these specific details are possible while still achieving the results of the present invention. Well-known processing steps and materials are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

Disturbance-Sensing System

Figure 1:
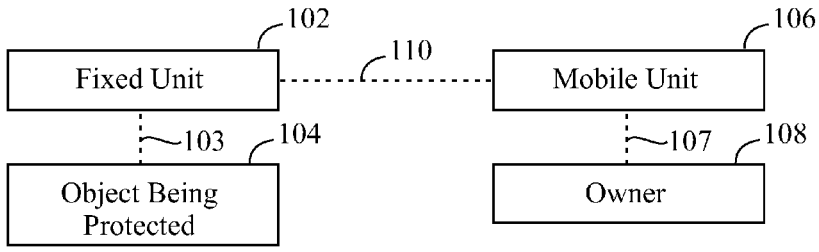
FIG. 1 is a diagram of a disturbance-sensing system, according to the invention.

FIG. 1 is a diagram of a disturbance-sensing system 100 comprising a fixed unit 102 which is associated with an object to be protected 104 against (or monitored for the occurrence of) a disturbance, and a mobile unit 106 which is associated with an entity such as a person 108 responsible for (or concerned about the non-disturbance of) the object to be protected 104, such as the owner of (or person responsible for, such as a "custodian") the object to be protected.

The fixed unit 102 may be attached to the object being protected 104, or otherwise disposed in proximity to the object being protected 104, as indicated by the dashed line 103.

The owner 108 may be remote (far from, at a distance from) the object being protected 104 such that he cannot observe the object being protected 104 to determine if an "alarm" event (such as movement of the protected item 104) is occurring, such an event generally being indicative of tampering with or theft of the object being protected 104. The owner 108 may, for example, carry the mobile unit 106 on his person, as indicated by the dashed line 107.

Therefore, there is a communication link 110 between the fixed unit 102 and the mobile unit 106. This link may be a direct link, or an indirect link. A direct link might be a simple RF signal sent be the fixed unit 102 to the mobile unit 106. Or, the link may be indirect, utilizing an intermediary (a third party entity), such as a cellular phone network, or the Internet.

The general idea is that the fixed unit 102 should be an independent portable (small and self-powered) unit for disposing in proximity to (or on) or attaching (securing) to the object being protected 104, for sensing an "alarm" event (such as movement of the protected item) and remotely notifying the owner 108 (such as by cell phone or pager, or Internet) that an alarm event (such as movement of the object being protected 104) is occurring. The owner 108 would generally carry the remote mobile unit 108. The mobile unit 108 may, for example, simply be the owner's cell phone. In this regard, the owner 106 can receive an alert anywhere that he has a signal.

The system (particularly the fixed unit) may also be used to alert, and help protect from unauthorized entry, such as unauthorized entry into a home, office, storage space, locker, garage, shed, or other space which may be secured. The object bring protected may include, for example, any of the following:

- a car, a bicycle, a motorcycle, a truck, a jet ski, a boat,
- a shipment of valuable goods, and other valuable moveable property
- a door or a window
- a briefcase, a computer case
- a musical instrument
- a gym locker, or gym bag
- a fence gate, a hotel room door
- a swimming pool float alarm,
- a baby's crib
- generally, any item that is susceptible to tampering or theft.

As discussed in greater detail hereinbelow, an embodiment of the fixed unit 102 may be in the general form of an elongate, hollow housing, such as generally in the form of a flashlight (such as of the type using 2 or 3 "D" size batteries), and the housing may include a combination or sub-combination of the following "electrical components":

Electrical Components

Figure 2:
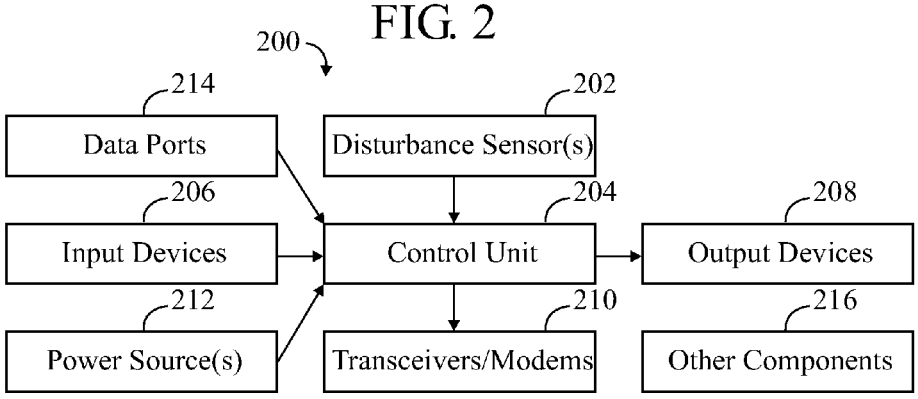
FIG. 2 is a diagram of a fixed unit for the disturbance-sensing system, showing the "electronics", according to the invention.

FIG. 2 is a diagram of the fixed unit 200 (compare 102), setting forth and describing its functions (the "electronics").

The fixed unit 200 may comprise one or more disturbance-sensors 202 for sensing an alarm event. For example, a disturbance sensor 202 for sensing (detecting) motion may comprise a mercury switch, or an acoustic motion detector, or an accelerometer. Other alarm events may be sensed when the disturbance sensor 202 comprises, for example, a proximity switch (which could detect if someone simply touches the object being protected), or a thermal sensor (which might detect an abnormal temperature situation, such as may occur in a house fire), or an acoustic sensor (which might detect if there were an unusual commotion in the vicinity of the object being protected. Generally, the disturbance sensor 202 may comprise any sensor that can detect a condition which may change if there is an "alarm" event classified as (defined as) a disturbance, and for which the owner 108 should be notified.

The fixed unit 200 may also comprise a control unit 204 receiving signals from the disturbance sensor(s) 202, and managing the overall operation of the fixed unit 200. The control unit 204 may include a microprocessor, and means (such as RAM) for storing instructions relevant to its operation.

One or more input devices 206, such as switches, may be provided for controlling operating states of the fixed unit 200, for example:

- an on/off switch
- a motion-sensitivity switch or control (rheostat)
- a keypad (or a truncated set of buttons) for inputting data or for cursor control One or more output devices 208, such as indicator lamps, may be provided for indicating operating conditions of the fixed unit 200, for example:

- an LED which illuminates when the fixed unit 102 is turned on"
- a battery level indicator
- an LCD display screen for displaying text and/or graphics, such as battery charge status
- an annunciator such as a speaker, which may emit an alarm signal which is audible to anyone (including an intruder) in the vicinity of the fixed unit when the alarm event has occurred The fixed unit 200 may also comprise one or more transceivers or modems 210 for establishing the aforementioned communication link (110) between the fixed unit 200 (102) and the mobile unit 106, either directly or indirectly. This may include, but is not limited to:

- a direct RF connection between the fixed unit and the mobile unit
- an indirect connection via the cellular phone network
- an indirect connection via a pager network
- an indirect connection via a wireless (such as IEEE 802.11) computer network
- optionally, a receiver for receiving a signal from the mobile unit, directly or indirectly, such as (but not limited to) over the cell-phone network, for example to remotely select a mode of operation for the fixed unit (such as simply on/off). (It should be understood that the communications protocols for some of the communications links mentioned above, such as cellular, may require two-way data communication even if it appears that the communication is only one-way (outbound) and only a transmitter ought to be required.)
- appropriate antennas may be included, if necessary.

The fixed unit 200 may also comprise one or more power sources 212 for operating the fixed unit. This may include, for example,

- rechargeable batteries
- backup batteries
- a plug for plugging into a wall socket (such as for recharging the rechargeable batteries)

Alternatively, a separate power supply may be used to provide power to the fixed unit, during operation and/or for recharging the rechargeable batteries.

The fixed unit 200 may also comprise one or more data ports 214, such as a USB plug, so that the fixed unit 200 may be connected with a computer, such as for setting features within the fixed unit 200, such as the telephone number to be dialed in case of an alarm event and/or a text message to be sent. The data ports 214 may comprise non-contact ports such as Bluetooth or IR.

The fixed unit 200 may also comprise one or more "other" electrical components 216 which may not be directly related to sensing-disturbance, such as a lamp and lens so that the fixed unit may be used as a flashlight by the owner. Or, a transducer such as a speaker (which may be one of the output devices 208) so that the owner can press a switch which will cause a loud siren sound (or an ultrasonic signal) to be emitted, to scare off potential intruders, or annoying animals. Or, a microphone, so that the owner can use the fixed unit 200 as a cellular phone. These "other" components 214 are not shown as being connected with any of the other components 202-212.

Mechanical Configuration

As mentioned above, the mobile unit 106 may be an ordinary cell-phone, and therefore does not warrant any further description herein.

As mentioned above, the fixed unit 102 may be in the general form of an elongate, hollow housing (generally cylindrical tube), such as generally in the form of a common household flashlight (such as of the type using 2 or 3 "C" or "D" size batteries). For example, 5-10 inches long, and 2-3 inches in diameter.

Figure 3:
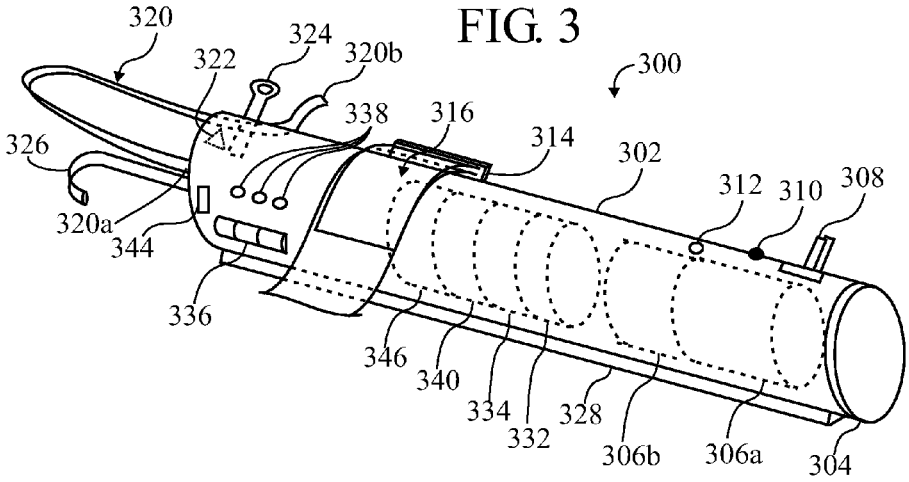
FIG. 3 is a diagram illustrating a mechanical configuration for the fixed unit of the disturbance-sensing system, according to the invention.

FIG. 3 is a diagram illustrating a configuration for the fixed unit 300 (102). More particularly, the fixed unit may include a combination or sub-combination of the following "mechanical components":

- a cylindrical tube 302 for housing electrical and mechanical components of the mobile unit
- an end cap 304 at one end of the tube (housing) 302 allowing, for example, for batteries 306*a* and 306*b* to be inserted from one end of the housing 302.
- One or more of the batteries 306*a* may be rechargeable batteries. Another one or more of the batteries 306*b* may be "backup" batteries, and may not be rechargeable. (The batteries correspond to the aforementioned power sources 212)
- A fold down (flip up, flip out) plug 308 may be provided on an external surface of the housing for plugging the unit into household current for the purpose of recharging the batteries 306*a*. A button 310 may be provided for causing the connector to flip out.
- A connector 312 may be provided on an external surface of the housing for plugging an external charging unit into the housing to recharge the batteries.
- A slotted bracket 314 may be provided on an external surface of the housing for use with a non-locking strap 316. Although this is shown positioned midway along the housing 302, the bracket and strap may be positioned near the bottom end of the cylindrical tube 302. The non-locking strap 316 may be a convenient means for attaching the present invention to a moveable object. The non-locking strap 316 may be made of a flexible material such as cloth, vinyl or rubber, and may include hook and loop fasteners (Velcro). Alternately, the non-locking strap 316 may include snaps, clasps or other like reusable fasteners commonly found in industry. The non-locking strap 316 may be held in position on the housing 302 by placing the strap 316 through a slotted bracket 314. The slotted bracket 314 may be attached to the outer surface of the housing 302 and may be positioned parallel to the length dimension of the housing 302.
- A locking strap or cable 320 may be provided so that the fixed unit can be secured to the object to be protected, requiring a key 322 (or a combination) to remove the fixed unit from the object to be protected. The locking strap or cable 320 may comprise a flexible cable that is made of wound steel, plastic, or other durable material that is resistant to cutting, may be positioned on the top end of the housing 302, and may have one end 320*a* which is secured to the housing 302. A second, free end 320*b* of the flexible cable 320 may be inserted from external the housing, through an opening (not visible) in the top end of the housing 302 and exit a side of the housing, as illustrated. In this manner, the free end 320*b* of the flexible cable 320 can be passed (wrapped) around an object to be protected such as an automobile steering column, a bicycle frame, or a motorcycle handlebar, then inserted into the housing 302. The free end 320*b* of the flexible cable 320 may be retained in place by any suitable friction and/or locking mechanism 322 (illustrated as a triangle) such as a pawl, steel grips, ratchet, or other pressure technology. The cable itself may be provided with ridges to aid in locking. An analogy would be plastic cable ties, where a free end of the tie is ridged, and when passed through a notch having corresponding pawl, cannot easily be withdrawn. In this case, a key 324 is provided which, when inserted into the housing 302, cooperates with the locking mechanism 322 to release the cable 320. This is intended to be a way of easily attaching (and subsequently un-attaching) the housing to an object being protected. The key 324 may also serve to turn on the device. A digital keypad could be provided instead of the key 324, for the cable locking and/or device turning-on features.

In contrast to the cable 320, which may be used to "lock" the housing to an object being protected, the non-locking strap 316 provides a less "secure" way of attaching the housing to an object being protected. The non-locking strap has the advantage that it can easily be replaced (or substituted) by the user putting another strap (comparable to 316) of any length through the slotted bracket 314. A key (324) would not be required to remove the housing from an object being protected when the non-locking strap 316 is used.

a simple hook 326 may be provided, extending for example from the top end of the housing 302, so that the so that the fixed unit can simply be hung from the object being protected. Thus far, three means for attaching the housing (the fixed unit) to an object being protected have been discussed: (1) the strap 316, the cable 320, and the hook 326.

a magnetic strip 328 may be provided along a side of the housing 302 so that the fixed unit can be magnetically attached to the object to be protected, providing yet another means for attaching the housing to an object being protected.

The fixed unit need not, in all cases, be "attached" to the object being protected. It may simply be placed on or in the object being protected, or near the object being protected. For example, it can simply be placed on the seat of a car, or in the case of a musical instrument. The bottom end of the housing provides a flat surface so that the fixed unit can be stood up on top of an object being protected. And, small movements of the object being protected may cause the fixed unit to fall over, thereby "amplifying" the motion. The magnetic strip 328 also provides a flat surface, or at least a discontinuity in the circular (cylindrical) shape of the housing 302 so that the fixed unit can be laid down on a surface of object to be protected, and won't roll off. Alternatively, the housing itself can be provided with at least one flat side.

The fixed unit may include a combination or sub-combination of the following "electrical components": (The electrical "features" have been discussed above, with respect to FIGS. 1 and 2.)

some "electrical" components have been mentioned above, such as the batteries 306*a*, 306*b*, the flip out plug 308, and the charger plug 312. It was also mentioned that the key 324 could be used to turn the device on. These correspond to the power source(s) 212 described hereinabove (FIG. 2)

One or more disturbance sensors 332 (compare 202) may be provided, within the housing 302.

A control unit 334 (compare 204) may be may be provided, within the housing 302.

Various input devices 336 (compare 206) may be provided, on an external surface of the housing 302. This may include, for example a two (or more) position switch for selecting motion-sensitivity.

Various output devices 338 (compare 208) may be provided, on an external surface of the housing 302.

Transceivers and/or modems 340 (compare 210) may be provided, within the housing 302.

One or more data ports 344 (compare 214) may be provided, on an external surface of the housing 302.

One of more other components 346 (compare 216) may be provided, either within the housing 302 (as illustrated) or on an external surface of the housing 302.

Additional Features

Some additional mechanical and/or electrical features of the fixed unit may include a combination or sub-combination of the following:

the housing of the fixed unit may be substantially watertight, and may be buoyant so that, for example, the fixed unit will float if dropped overboard.

a red reflector on an external surface of the housing to make the fixed unit more visible when illuminated by a light source a mirrored surface for signaling or viewing a storage compartment, for valuables (such as keys or coins)

a built-in clock with LCD display cell-phone capability (including at least a speaker and microphone, or Bluetooth, or a speaker/microphone jack)

a strap for dangling the fixed unit from the owner's wrist, and a "dead-man switch" mode for calling police (or a security service)

the fixed unit may contain a small GPS tracking unit

Using the System

The mobile unit should be small and portable, easily carried by the owner. For example, if the communication between the fixed unit and the mobile unit is over the cell-phone network, the mobile unit may simply be the owner's cell phone. When a disturbance is sensed, the fixed unit can simply dial the owner's cell phone number, and it may be sufficient that the owner simply recognizes that he (the mobile unit) is being contacted ("beeped") by the fixed unit. Additionally, certain information can be sent by the fixed unit in an SMS (short message service) message.

While a number of exemplary aspects and embodiments have been discussed above, those of skill in the art will recognize that modifications, permutations, additions and sub-combinations thereof may be made thereto. It is therefore intended that the following appended claims and claims be interpreted to include all such modifications, permutations, additions and sub-combinations.

What is claimed is:

1. Disturbance-Sensing System comprising:

a fixed unit comprising a small and self-powered unit for associating with an object being protected, and for sensing an alarm event associated with the object being protected, and for remotely notifying the an owner or person responsible for the object being protected that the alarm event is occurring; and a mobile unit which may be carried by an owner of or person responsible for the object being protected, for receiving the notification of the alarm event;

wherein:

the fixed unit comprises an elongate, hollow housing, generally in the form of a flashlight;

further comprising:

one or more data ports so that the fixed unit may be connected with a computer.

2. The Disturbance-Sensing System of claim 1, wherein:

the fixed unit comprises means for attaching the fixed unit to or otherwise disposing the fixed unit in, on or in proximity to the object being protected.

3. The Disturbance-Sensing System of claim 1, wherein:

the mobile unit comprises a cell phone.

4. The Disturbance-Sensing System of claim 1, further comprising:

a communication link between the fixed unit and the mobile unit;

wherein the communication link comprises a direct link or an indirect link; and wherein the communication link comprises a cellular network, a paging network, or the Internet.

5. The Disturbance-Sensing System of claim 1, wherein the fixed unit comprises:

one or more disturbance-sensors for sensing an alarm event, at least one of which is a motion-detector;

a control unit receiving signals from the disturbance sensors, and managing overall operation of the fixed unit;

one or more power sources for operating the fixed unit;

one or more input devices for controlling operating states of the fixed unit; and one or more transceivers or modems for establishing a communication link between the fixed unit and the mobile unit, selected from the group consisting of:

a direct RF connection between the fixed unit and the mobile unit;

an indirect connection via the cellular phone network;

an indirect connection via a pager network; and an indirect connection via a wireless computer network.

6. The Disturbance-Sensing System of claim 1, wherein the fixed unit comprises:

one or more output devices for indicating operating conditions of the fixed unit.

7. The Disturbance-Sensing System of claim 1, further comprising:

a receiver for receiving a signal from the mobile unit to remotely select a mode of operation for the fixed unit.

8. The Disturbance-Sensing System of claim 1, wherein:

the system is used to alert, and help protect from unauthorized entry into a home, office, storage space, locker, garage, shed, or other space which may be secured; and the object bring protected is selected from the group consisting of: a car, a bicycle, a motorcycle, a truck, a jet ski, a boat, a shipment of valuable goods, valuable moveable property, a door, a window, a briefcase, a computer case, a musical instrument, a gym locker, or gym bag, a fence gate, a hotel room door, a swimming pool float alarm, a baby's crib, and generally, any item that is susceptible to tampering or theft.

9. A fixed unit for a disturbance-sensing system comprising:

a small, self-powered unit for associating with an object being protected, and for sensing an alarm event associated with the object being protected, and for remotely notifying the an owner or person responsible for the object being protected that the alarm event is occurring;

wherein the fixed unit is in the general form of an elongate, generally cylindrical, hollow housing, generally in the form of a common household flashlight;

batteries disposed in the housing; and further comprising:

one or more data ports so that the fixer unit may be connected with a computer.

10. The fixed unit of claim 9, wherein the batteries comprise:

first one or more batteries which are rechargeable batteries, second one or more batteries which are backup batteries.

11. The fixed unit of claim 9, further comprising:

a flip out plug provided on an external surface of the housing for plugging the unit into household current for the purpose of recharging the batteries.

12. The fixed unit of claim 9, further comprising:

a non-locking strap having fasteners; and a slotted bracket disposed on an external surface of the housing for use with the strap.

13. The fixed unit of claim 9, further comprising:

a locking strap for securing the fixed unit to the object being protected; and requiring a key for removing the fixed unit from the object being protected.

14. The fixed unit of claim 13, wherein:

the locking strap comprises a flexible cable that is made of wound steel, plastic, or other durable material that is resistant to cutting.

15. The fixed unit of claim 13, wherein:

the locking strap is positioned at an end of the housing, having a first end which is secured to the housing and a second, free end which may be inserted from external the housing through an opening in the housing and exit a side surface of the housing.

16. The fixed unit of claim 15, further comprising:

means for retaining the free end of the locking strap in place, and for releasing the locking strap when a key is inserted.

17. The fixed unit of claim 9, further comprising:

a hook extending from an end of the housing so that the so that the fixed unit can be hung from the object being protected.

18. The fixed unit of claim 9, further comprising:

a magnetic strip provided along a side of the housing so that the fixed unit can be magnetically attached to the object being protected.

* * * * *